United States Patent [19]

Gould

[11] Patent Number: 4,735,417

[45] Date of Patent: Apr. 5, 1988

[54] PUZZLE

[76] Inventor: Murray J. Gould, 11712 Silent Valley La., Gaithersburg, Md. 20878

[21] Appl. No.: 66,168

[22] Filed: Jun. 25, 1987

[51] Int. Cl.[4] ..... A63F 9/08

[52] U.S. Cl. ..... 273/153 S

[58] Field of Search ..... 273/153 S, 155, 281

[56] References Cited

U.S. PATENT DOCUMENTS

| | | | |
|---|---|---|---|
| 560,197 | 5/1896 | Dow . | |
| 636,109 | 10/1899 | Bowers | 273/153 S |
| 1,811,960 | 6/1931 | Orr . | |
| 2,095,046 | 10/1937 | Wilner | 273/153 R |
| 2,824,740 | 2/1958 | Cowan . | |
| 3,317,210 | 5/1967 | DiMeo . | |
| 3,492,756 | 2/1970 | Stubbmann . | |
| 3,655,194 | 4/1972 | Pierson | 273/153 S X |
| 4,415,158 | 11/1983 | Engel | 273/153 S |
| 4,468,033 | 8/1984 | Minami et al. | 273/153 S |
| 4,550,040 | 10/1985 | Fisher | 273/153 S X |
| 4,580,783 | 4/1986 | Cohan | 273/153 S |

FOREIGN PATENT DOCUMENTS

| | | | |
|---|---|---|---|
| 54886 | 6/1982 | European Pat. Off. | 273/153 S |
| 8123478 | 8/1981 | Fed. Rep. of Germany | 273/153 S |
| 3143735 | 5/1983 | Fed. Rep. of Germany | 273/153 S |
| 2516805 | 5/1983 | France . | |
| 8501666 | 10/1984 | World Int'l Prop. O. . | |
| 422704 | 1/1935 | United Kingdom | 273/155 |
| 2117256 | 10/1983 | United Kingdom | 273/153 S |
| 1183136 | 10/1985 | U.S.S.R. . | |

*Primary Examiner*—Anton O. Dechsie

*Attorney, Agent, or Firm*—Cushman, Darby & Cushman

[57] ABSTRACT

A puzzle in which a plurality of object members can be rotatably manipulated in groups of four, the groups of four overlapping so that a single object member can be moved from one of the groups to another. Each of the object members has an upper surface which may be given a particular color or image so that a user may derive enjoyment from arranging the object members into a desired pattern based on their colors or images.

2 Claims, 2 Drawing Sheets

FIG. 4
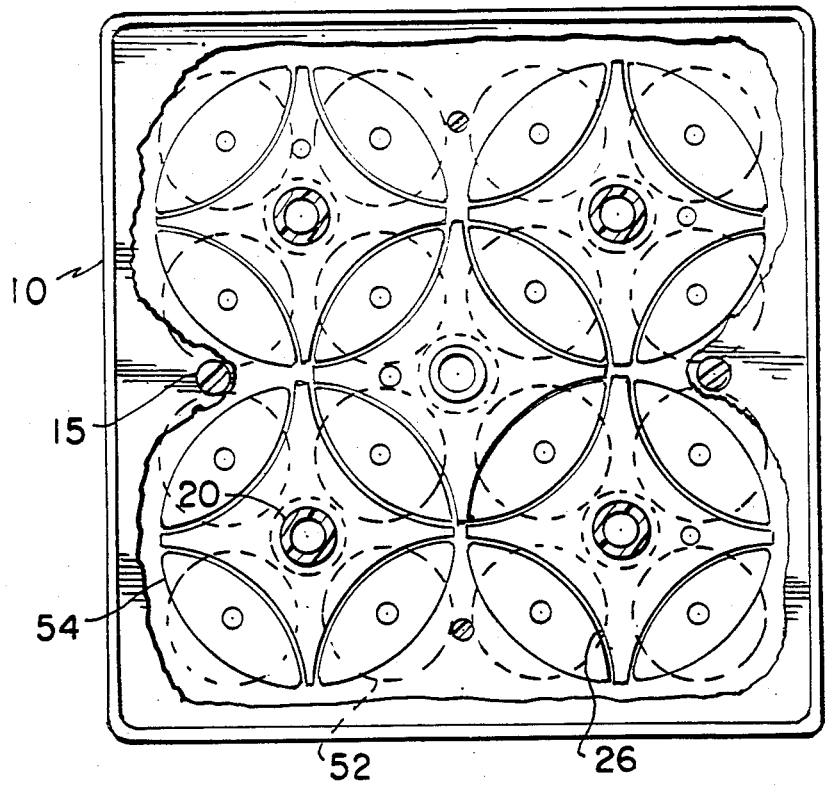
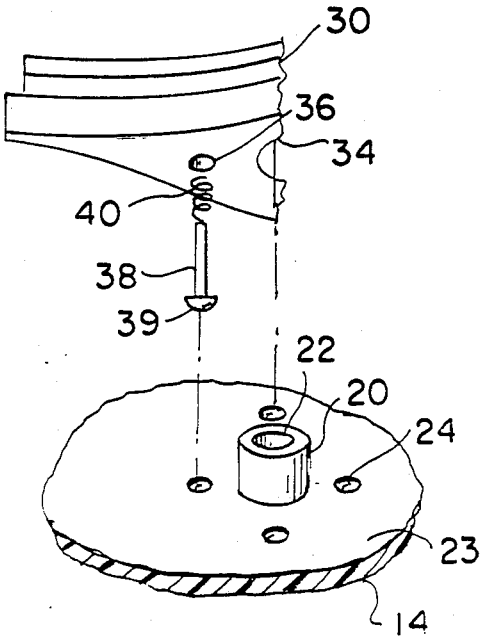
FIG. 6
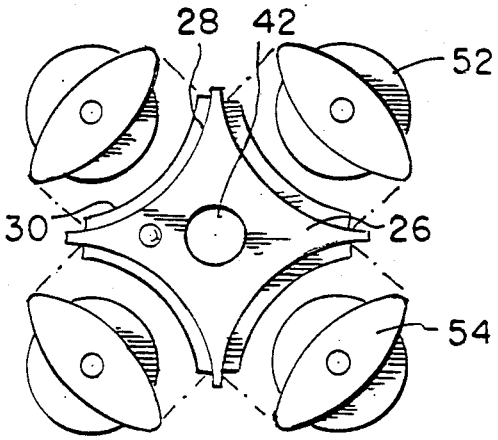
FIG. 5

PUZZLE

BACKGROUND OF THE INVENTION

The present invention relates to a puzzle which can be used for personal entertainment.

In the past, puzzles have been developed that test the users skill in rearranging a number of colored elements which form each of the six faces of a cube. Such puzzles were particularly and interestingly difficult to solve, mainly because it was impossible to move one of the colored elements without changing the orientation of other elements on other faces of the cube. The difficulty of these types of puzzles captured the public imagination, and brisk sales followed throughout the United States and the world.

Puzzles having fourteen or more sides based on the original permutatable color principle were then developed. However, such puzzles are in reality quite similar to the cube puzzle. A need exists for a simple yet challenging puzzle that is geometrically and mechanically dissimilar from a cube puzzle and is not solvable by the same algorithms as the cube puzzle.

SUMMARY OF THE INVENTION

It is an object of the present invention to provide a simple yet challenging puzzle by which an individual can provide hours of enjoyable entertainment for his or her self.

The present invention provides a puzzle having a plurality of movable object members in which groups of object members are rotatable in a plane about a plurality of pivot points, each object member being positionable adjacent at least two pivot points so as to enable each object member to replace any other object member.

More particularly, the present invention provides a puzzle having a plurality of sliding object members each having a "checker" like member on an upper surface thereof, each member being a particular color, so that a user can attempt to rearrange the checkers in terms of their position to produce a desired pattern. Alternatively, the present invention may be used as a amusement device or teaching tool wherein each of the sliding object members is etched or laminated with the image of an animal or other figure, the animal figures being arrangeable in type in terms of type, genus or color.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 4 is a bottom cut-away view of the puzzle shown in FIG. 1;

FIG. 5 is a fragmentary exploded view of the rotating vane and object pieces of the puzzle shown in FIG. 1; and FIG. 6 is a fragmentary exploded view of the click stop arrangement between the rotating vane members and the bottom portion of the housing in the apparatus illustrated in FIG. 1.

DETAILED DESCRIPTION OF THE PREFERRED EMBODIMENT

Figure 1:
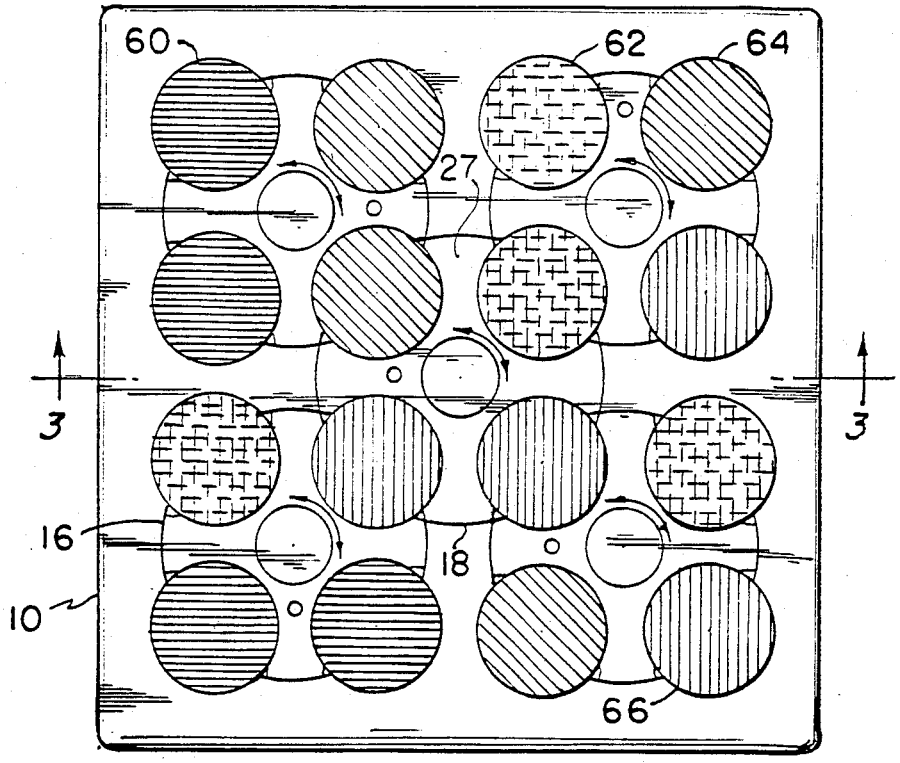
FIG. 1 is a top plan view of a puzzle constructed according to the present invention.
Figure 2:
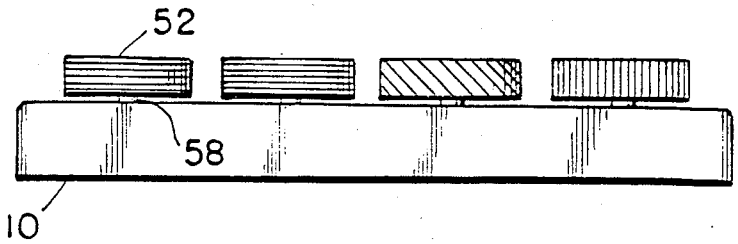
FIG. 2 is a side elevation view of the puzzle shown in FIG. 1.
Figure 3:
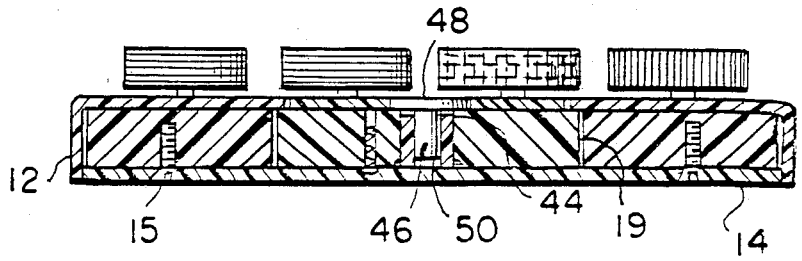
FIG. 3 is a cross-sectional view taken along lines 3—3 in FIG. 1.

Referring to FIGS. 1–3, a preferred embodiment of the present invention is illustrated wherein a housing 10 is constructed of an upper portion 12 having an upper surface and a bottom portion 14. The upper portion 12 of the housing is secured to the bottom portion 14 by means of a plurality of screws 15, as is shown in FIG. 3. As illustrated in FIG. 1, the upper portion 12 has a circular center inner opening 18 and four circular satellite outer openings 16 defined in its upper surface. Each of the four outer openings 16 overlaps the circular inner opening 18.

As best illustrated in FIGS. 3 and 6, the bottom portion 14 of housing 10 is provided with a plurality of upstanding cylindrical pivot support projections 20 that are concentric with the inner and outer circular openings in the upper housing portion 12 when the housing is assembled. Each of the pivot support projections 20 is formed with an axial bore 22 defined therein. An inner surface 23 of the bottom housing portion 14 has a plurality of detents 24 formed therein, each support projection 20 having four such detents spaced an equal distance therefrom.

A plurality of vane members 26 are provided for rotation about each of the cylindrical pivot support projections 20, as is shown in FIGS. 1 and 4. An axial bore 42 defined in each of the vane members 26 receives one of the pivot support projections 20. For example, a central vane member 27 is mounted for rotation about the pivot member that is coaxial with the inner opening 18 in the housing, as shown in FIGS. 1 and 4. Peripheral vane members 29 are mounted for rotation in each of the outer openings 16. Each of the vane members 26 has four concave side surfaces 28, a pivot support plate having a flat upper surface 32, and a flat lower surface 34.

As shown in FIG. 6, the lower surface 34 of each vane member has a pinhole 36 formed therein for receiving a pawl member 38 and a biasing spring 40. The pawl member 38 has a rounded head portion 39 thereon for engaging the detents 24 that are provided in inner surface 23 of the bottom housing portion 14. In this way, the vanes will "click stop" each time one is rotated through a one quarter turn.

Further defined in each of the vane members 26 is a counter sunk recess 44 that is coaxial with the bore 42. The vanes are retained on the pivot support projections 20 by a retaining member 46 that includes a head portion 48 and a cylindrical body portion 50. Head portion 48 mates with the counter sunk recess 44 and the vane member 26, so as to form a flush upper surface with the vane member. The cylindrical body portion 50 of the retaining member is received in bore 22 of a pivot support projection 20. In this way, the vane members 26 may be rotated without sliding off the pivot support projections 20.

The present invention is provided with a number of object pieces 52, each of which, in the preferred embodiment, comprises an oval slider member 54, a colored checker member 56 and a connecting pin or projection 58 for connecting the slider member to the checker member. In the embodiment illustrated in FIG. 1, the present invention includes four each of blue checker members 60, yellow checker members 62, green checker members 64 and red checker members 66.

As shown in FIG. 4, each slider member 54 is positioned within a recess defined by one of the concave side surfaces 28 of a vane member and either an inner wall 19 of the circular outer or inner openings 16, 18 or a concave side surface of another vane member 26. Each of the slider members 54 are further retained within the housing 10 by the outwardly projecting upper lip portions 30 of the upper vane members.

In operation, a group of four object pieces 52 surrounding one of the vane members may be manually rotated in a clockwise or counterclockwise direction along with the vane member, as illustrated by the arrows in FIG. 1.

It will be noted that each of the object pieces 52 that are positioned for rotation with the central vane member 27 are also rotatable with one of the peripheral vane members 26. For this reason, an object member originally positioned entirely within one of the four circular outer openings 16 may be moved into the circular inner opening 18 while rotating the adjacent peripheral vane member 26. That object piece may be further repositioned by rotating the central vane member 27, and may ultimately be repositioned in another of the four circular outer openings 16 by the same process. From this, it is evident that the position of any two object pieces 52 may be juxtaposed, and that the various colored checker members 56 on the object pieces may be repositioned over the upper surface of the housing into desired groups or patterns.

As shown in FIGS. 1 and 3, the upper surface 32 of the pivot support plate mounted to each of the vane members is substantially coplanar with the upper surface of the upper portion 12 of the housing, and at least partially covers the slider members so as to hide the mechanisms which permit the object members to move within the housing. The connecting pins or projections 58 extend through gaps defined between the plates, and the checker members serve to substantially cover the portions of the sliders that are not covered by the plates. This creates an overall optical effect of a number of manipulable groups of colored checkers against an essentially unbroken background surface that makes the puzzle even more attractive and interesting to the user.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A puzzle or game for use for personal entertainment, comprising:

a housing having an upper surface defining a plurality of closed movement paths;

plurality of vane members mounted for rotation about fixed axes separated from each other, each vane member having a plurality of adjacent inwardly curved surfaces around the periphery thereof;

a plurality of slider members each having opposed outwardly curved surfaces, each slider member being mounted with an outwardly curved surface fitted against a curved surface of one of said vane members, at least one slider member fitted against each vane member having an opposing outwardly curved surface fitted to a curved surface of an adjacent vane member so that rotation of either of said adjacent vane members rotates each slider member fitted to the curved surfaces of that vane in a closed path about the fixed point thereof;

a plurality of object members, each having a planar upper surface bearing a color or design and lower surface and a projection extending downwardly from each object member to connect that object member to a slider member so that said object member moves therewith;

a plurality of pivot support plates each mounted to a vane member for rotation therewith and coplanar with said housing upper surface, with said slider members sandwiched between two of said pivot support plates or between one of said pivot support plates and said housing upper surface so that said slider members and partially covered by said plates and said upper surface and said projections each extend between adjacent plates and said upper surface, with the space thus defined between said plates and said upper surface being substantially covered by said object members whereby the slider and vane members that move the object members within the housing are substantially hidden by the upper surface of the housing and the pivot support plates.

2. Apparatus according to claim 1, wherein each of said vane members includes an outwardly projecting upper lip portion for retaining said slider members within said housing.

* * * * *